United States Patent [19]

Partus et al.

[11] Patent Number: 4,638,129

[45] Date of Patent: Jan. 20, 1987

[54] CONTROL SWITCH COVER

[75] Inventors: Fred P. Partus, Marietta; Michael A. Jones, Atlanta, both of Ga.

[73] Assignee: National Product Marketing, Atlanta, Ga.

[21] Appl. No.: 681,668

[22] Filed: Dec. 14, 1984

[51] Int. Cl.[4] ..... H01H 9/20

[52] U.S. Cl. ..... 200/43.22; 200/50 A; 361/390

[58] Field of Search ..... 361/391, 390, 392, 357; 200/52 R, 61.58 R, 50 A, 43.22, 210; 220/210

[56] References Cited

U.S. PATENT DOCUMENTS 3,096,409 7/1963 Hubbel et al. ..... 70/161 X

*Primary Examiner*—A. D. Pellinen
*Assistant Examiner*—Morris Ginsburg
*Attorney, Agent, or Firm*—Needle & Rosenberg

[57] ABSTRACT

The present invention is an externally installed control switch cover assembly to be used with equipment with a ribbed edge and the control switch located adjacent to the ribbed edge. More particularly, the present invention may be used on an IBM-PC computer to cover, protect and lock into position the power switch of the computer.

10 Claims, 5 Drawing Figures

CONTROL SWITCH COVER

BACKGROUND OF THE INVENTION

This invention pertains to the field of add-on locking devices to control access to existing equipment which does not otherwise contain means for locking the equipment.

Personal size computers have become prevalent in use in uncontrolled or semi-controlled settings, such as the home or in offices. Few, if any, of the currently available personal computers incorporate means for limiting physical access to the power switch of the computer. However, it has become increasingly desirable to limit such access to personal computers, to protect from either intentional access to information or intentional or unintentional shutting off of the computer while in use.

In addition, most personal computers are built in cabinets with easily removable panels, which allow access to circuit boards containing memory and other electronic circuitry. It is also desirable to prevent unpermitted removal of such panels and access to the internal electronics of such computers.

One of the most popular personal computers is currently the IBM-PC. The IBM-PC is built into a metal cabinet with a removable back panel which is recessed and held in place by two screws near each side edge of the panel. Since the back panel is recessed, a rib is formed around the periphery of the back of the cabinet approximately three-eighths inch deep. In addition, the power control switch for this computer is located on one side of the cabinet, adjacent to the rear rib of the cabinet. The power switch housing is inserted into a cutaway in the cabinet, and since it is a separate piece, there is a small space between the power switch housing and the cabinet, where the cabinet overlaps the switch housing.

Presently, the IBM-PC does not incorporate a locking means for its power switch. Therefore, an add-on locking means is desirable. However, most users do not desire to install such a lock by means of drilling the cabinet, since that would leave unsightly holes and may damage the internal electronics of the computer. Furthermore, a simpler method of installation is desired in most cases.

SUMMARY OF THE INVENTION

The present invention is an externally installed control switch cover to be used with equipment with a ribbed edge and the control switch located adjacent to the ribbed edge. More particularly, the present invention may be used on an IBM-PC computer to cover, protect and lock into position the power switch of the computer.

The present invention comprises a main body or master plate designed to be fitted over the power switch and lie flush against the cabinet, presenting an opening for access to the power switch only through the plate. The master plate also has an extension at one end with notches for engaging the ribbed rear edge of the computer. The master plate is held securely in place by a tension plate attached to the rear edge of the master plate by screws which are tightened to grip the ribbed edge, and by a tongue attached near the forward edge of the master plate which fits within the space between the power switch housing and the cabinet of the computer. A locking door is attached to the master plate for covering the access opening to the power switch and also for covering all of the securing screws of the device.

The invention may also comprise two additional features. First, an appropriately placed notch in the tension plate where it abuts the back panel of the IBM-PC computer allows it to cover one of the screws of the back panel when installed. This provides the additional security of preventing access to the inside of the computer by removal of the back panel.

Second, a projection may be added on the door of the invention so that when the door is closed the projection extends into the recessed area of the power switch, thereby preventing movement of the switch to the "on" or "off" position, as the case may be, by means of slipping something such as a card or a wire between the master plate and the computer cabinet.

Once installed, the only way to remove the control switch cover and, consequently, the back panel of the computer, is to open the lock door with a key and remove the lock by loosening the securing screws.

Although the invention as described herein is specifically designed to be installed on an IBM-PC personal computer, the invention may be adaptable to other computers or electronic equipment with ribbed edges in close proximity to a control switch which may be covered, without departing from the inventive aspects disclosed herein.

Therefore, it is an object of this invention to provide an add-on control switch cover for electronic or other equipment with a ribbed edge, to provide security for said equipment.

It is a further object of this invention to provide an add-on control switch cover which may be simply installed or removed without requiring modification or drilling of the equipment.

It is another object of this invention to provide a device for preventing removal of removable recessed panels in equipment.

These and other objects and advantages will appear from the following description with reference to the drawings.

DESCRIPTION OF THE PREFERRED EMBODIMENT

The preferred embodiments are now described with reference to the drawings, in which like numbers indicate like parts throughout the views.

Figure 1:
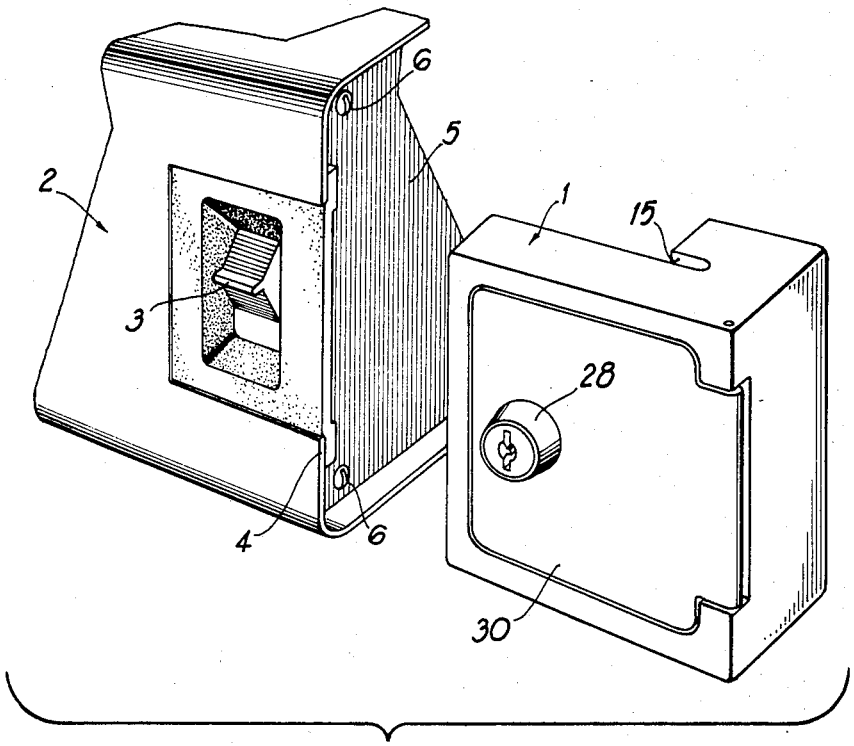
FIG. 1 is a perspective view of the invention and a cut-away portion of the equipment where the invention is to be installed.

FIG. 1 shows the control switch cover 1 and a portion of an equipment cabinet 2 having a recessed switch 3 located adjacent to an edge 4 of the cabinet. In the IBM-PC, this switch is a separate piece and the cabinet 2 has a cut-out which allows a portion of the switch to fit through the cut-out while the edges of the switch are overlapped by the cabinet. In this configuration a small gap between the edges of the switch and the cabinet exists or may be made by applying pressure to the casing of the switch.

The equipment cabinet for which the invention is useful has a recessed back panel 5 adjacent to and generally perpendicular to the face of the switch 3. Since the back panel 5 is recessed about three-eighths of an inch, the cabinet edge 4 forms a rib around the back panel. The back panel 5 may be attached to the cabinet by screws 6 or other removable fastening means, some of which may be located near the edge of the cabinet adjacent to the switch 3.

Figure 2:
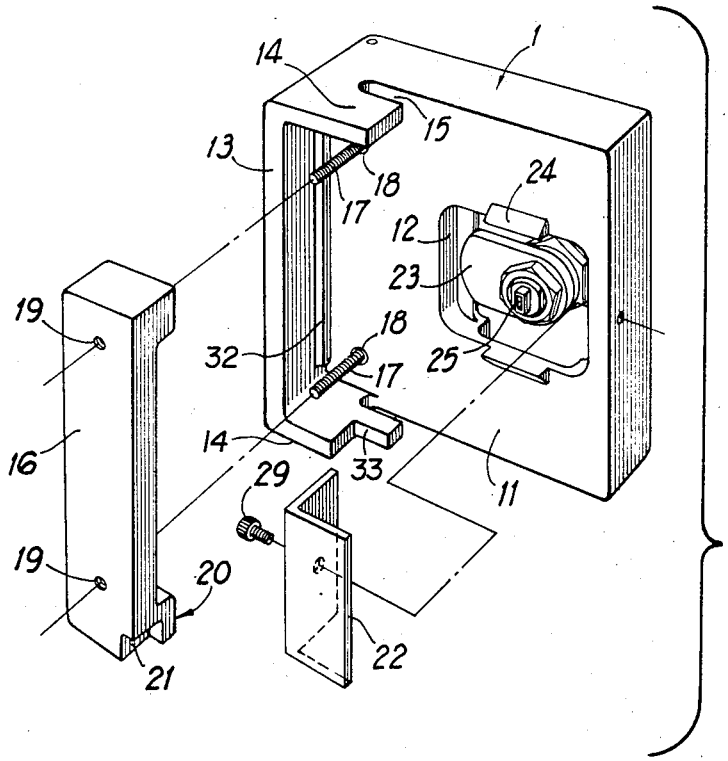
FIG. 2 is an exploded perspective view of the back side of the invention.

FIG. 2 shows the details of the elements of the invention 1. A master plate 11 is formed of hard material, such as a metal or plastic. The master plate 11 has a flat inside face to fit flush against the cabinet 2 over the switch 3. An opening 12 is provided through the master plate 11 to allow access to the switch through the master plate. The rear edge of the master plate has an el extension 13 beyond the plane of the inside face of the master plate.

Two flanges 14 at the top and bottom of the el extension 13 perpendicular to the el form an open frame facing towards the front edge of the master plate 11. Notches 15 are formed between the flanges 14 and the inside face of the master plate for receiving the ribbed edge 4 of the cabinet when the master plate is installed over the switch 3 and pressed forward against the ribbed edge 4. The notches 15 are long enough to completely receive the ribbed edge.

A tension plate 16 fits within the frame formed by the el extension 13 and the flanges 14, which completely surround the tension plate so that the tension plate cannot be pried away from the master plate. Two machine screws 17 attach the tension plate 16 to the master plate 11 through unthreaded holes 18 in the master plate and by threaded holes 19 in the tension plate. The holes 18 through the master plate are large enough to allow the threaded portion of the screw to pass freely through the master plate, but the holes 18 are smaller than the heads of the screws 17. The inside face of the master plate also has a raised area 32 between the el extension 13 and the holes 18 parallel to the el extension, which provides a fulcrum for the tension plate 16 when the screws 17 are tightened. The tension plate 16 has some flat surface area 20 on its face towards the inside face of the master plate. When the switch cover is installed on the equipment, the screws 17 are tightened to cause the ribbed edge 4 to be gripped between the inside face of the master plate and the flat surface area 20 of the tension plate. The raised area 32 is raised an appropriate amount to ensure that rib 4 is either evenly gripped or gripped away from the edge of the rib, for a secure hold on the cabinet 2.

The tension plate also has a recessed area 21 on its face which abuts the back panel 5 of the equipment, to cover a screw 6 when the invention is installed on the equipment with the tension plate 16 otherwise flush against the back panel. The lower flange 14 may also have a matching recess 33 for the same purpose. Thus, when the switch cover is correctly installed, the back panel of the equipment may not be easily or completely removed. This is especially useful in computers, where the electronics are usually installed on circuit cards designed to be easily inserted or removed through the back panel.

Figure 4:
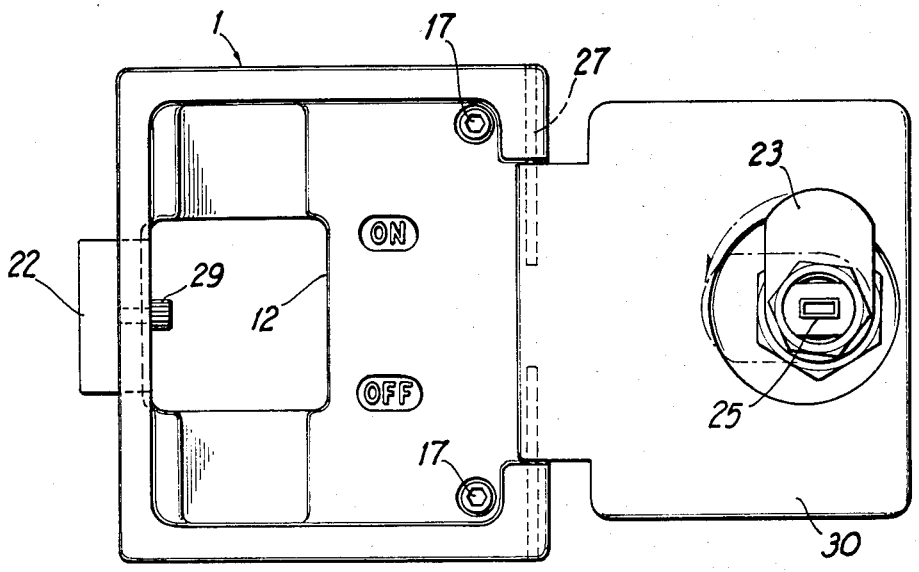
FIG. 4 is a front view of the invention with the door of the invention opened.
Figure 3:
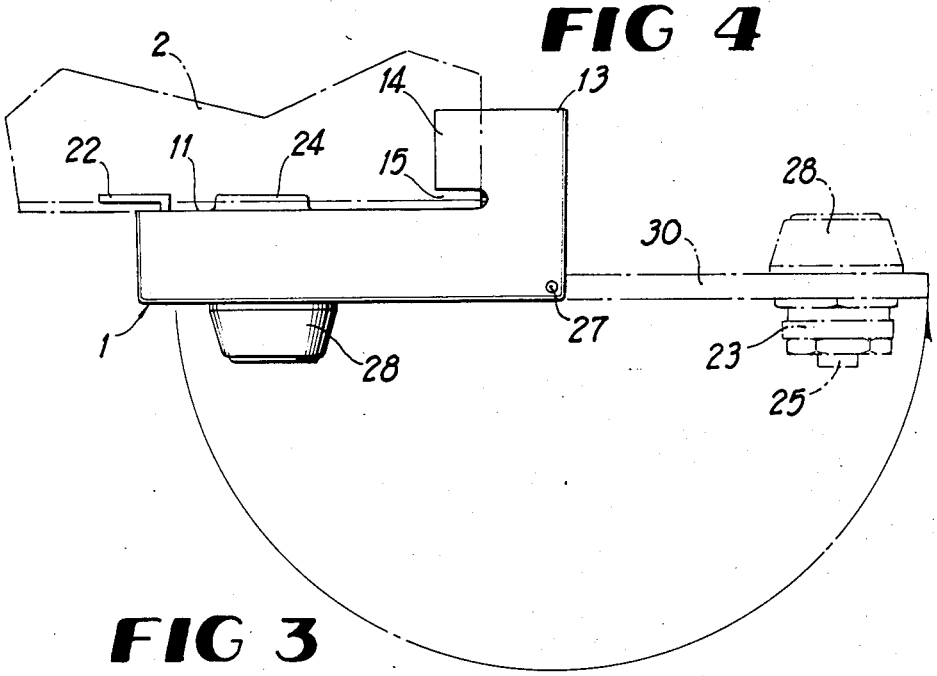
FIG. 3 is a top view of the invention.
Figure 5:
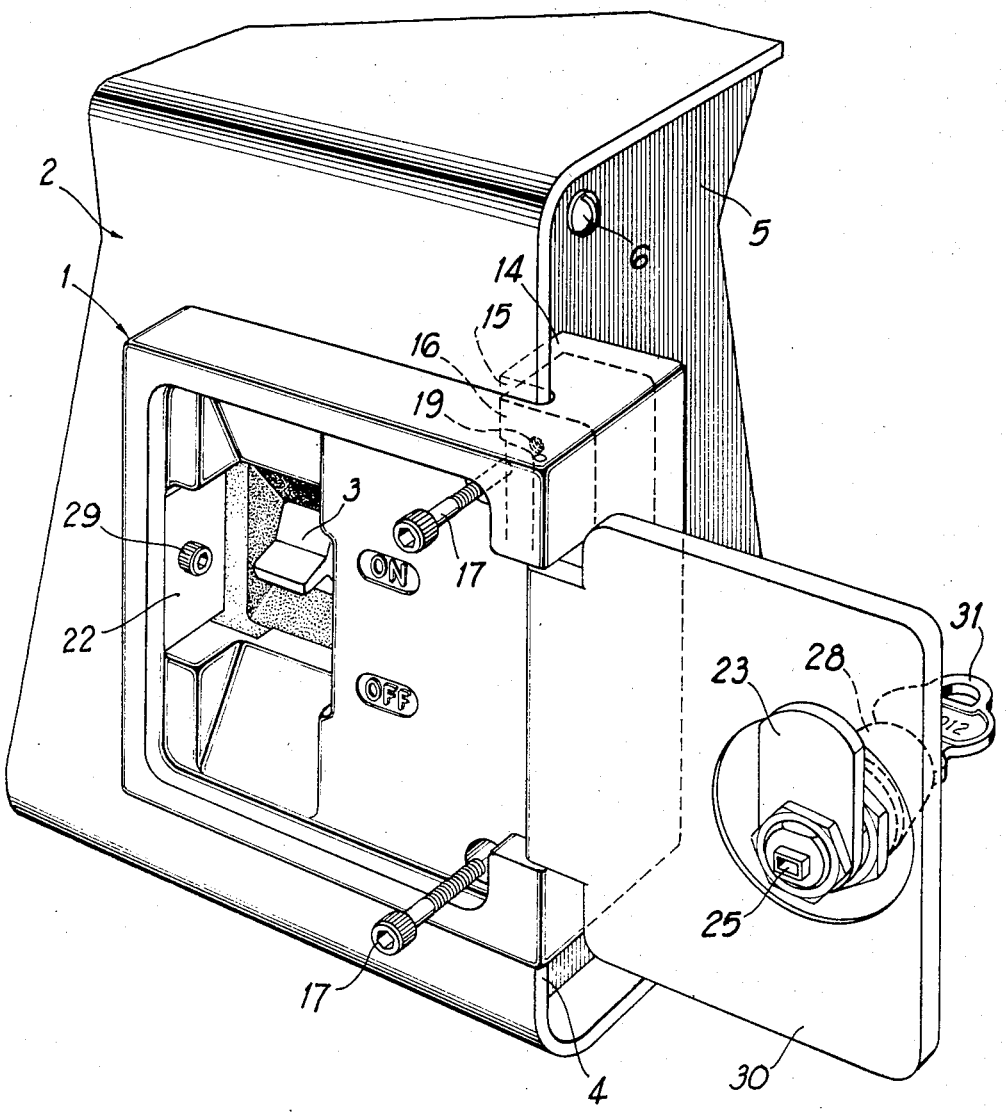
FIG. 5 is a perspective view of the invention partially installed on the equipment.

The remainder of the invention can best be understood by reference to FIGS. 2, 3 and 4 together. A tongue 22 is removably attached by screw 29 to the master plate. The tongue 22 has a right angle bend and is to be fitted into the space between the switch 3 and the cabinet 2 at the forward edge of the control switch (see FIG. 5). When the tongue 22 is installed, it serves the dual purpose of holding the forward edge of the master plate firmly against the cabinet as well as resisting rearward sliding of the master plate since the angled portion of the tongue will be held by the raised portion of the switch casing. Raised protrusions 24 around the opening 12 which fit within the upper and lower spaces between the switch and the cabinet also serve to properly locate the switch cover during installation and resist forces in any direction on the master plate when in place.

The control switch cover has a door 30 with a lock 28 connected to a locking cam 23. The door 30 is attached to the master plate 11 by means of pins 27. Preferably, the door 30 and the pins 27 are recessed into the master plate and the pins are non-removable, for added security.

It can be seen in FIG. 4 that the attaching screws 17 and 29 are accessible only when the door 30 is open, at which time they may be easily adjusted with an appropriate tool. However, when the door 30 is closed and locked, the screws 17 and 29, as well as the control switch 3 are no longer accessible and the equipment is secure from unauthorized access or unwanted shutoff.

One additional feature which can be seen on FIGS. 2 and 4 is the provision of a projection on the inside of the door to further prevent operation of the switch 3. This is provided in this embodiment by a nipple 25 projecting from the middle of the inside of the lock 28. When door 30 is closed, the nipple 25 projects into the recess of switch 3, thereby preventing movement of the switch from the "off" to "on" position, or vice versa, by such means as a card or a wire inserted between the cabinet and the master plate.

While this invention has been described in detail with particular reference to the preferred embodiment thereof, and in application to a particular machine, it will be understood that variations and modifications can be effected within the spirit and scope of the invention as previously described and as defined in the claims.

What is claimed is:

1. A control switch cover assembly, for attachment to the cabinet of electronic or other equipment having a lipped edge adjacent to a control switch, which comprises:

a master plate of one piece solid construction which comprises a major portion having a flat face and an opening for access to the switch when said master plate is installed over the switch, and an el-shaped extension at the rear of said flat portion having flanges at the top and bottom thereof which form a notch between each of said flanges and the flat face of said major portion, for receiving the lipped edge of the cabinet when said plate is installed over the switch;

a door connected to said master plate with locking means, for covering the switch access opening of said master plate;

a tension plate, received within said flanges and said el-shaped extension of said master plate;

means for connecting and tightening said tension plate to said master plate, for applying force to the lip of the cabinet when the lip is located within the notches of said master plate to hold the control switch cover assembly in place on the cabinet; and means for engaging said master plate with the control switch to prevent movement of the control switch cover assembly when the control switch cover assembly is installed over the switch.

2. The control switch cover assembly of claim 1, wherein said tension plate connecting means is accessible when said door is open, for installing or removing the control switch cover assembly, and said tension plate connecting means are inaccessible when said door is closed, so that the tension plate may not be loosened when the control switch cover assembly is installed and said door is closed and locked.

3. The control switch cover assembly of claim 2, wherein said tension plate connecting means comprises at least two screws which engage threaded holes in said tension plate through matching unthreaded holes in said master plate, and wherein the holes in said master plate are located such that said screws will not interfere with the lipped edge of the cabinet being fully received within said notches.

4. The control switch cover assembly of claim 3, wherein said master plate has a raised area on its inside face, between the el-shaped extension of said master plate and the screw holes of said master plate, for providing a fulcrum for said tension plate when said screws are tightened.

5. The control switch cover assembly of claim 1, wherein said master plate has a recessed area on its face, and wherein said door fits completely within said recessed area and is connected to said master plate by non-removable means.

6. The control switch cover assembly of claim 1, wherein said control switch engaging means comprises a tongue for fitting between the control switch to be covered and the cabinet of the equipment, attached to said master plate at a point interior to the switch access opening of said master plate.

7. The control switch cover assembly of claim 1, wherein said control switch engaging means comprises at least one protrusion from the flat face of said master plate for mating with recesses in said control switch in a tightly fitted relationship, for prevention of movement when said control switch cover assembly is installed over the switch.

8. The control switch cover assembly of claim 1, which further comprises a projection on the inside of said door which projects into the switch access opening of said master plate when said door is closed, for preventing the movement of the control switch covered thereby either accidentally or by means of force applied between said control switch cover assembly and the cabinet of the equipment.

9. The control switch cover assembly of claim 1, where said cabinet further includes a removable back panel secured by screws, wherein said tension plate has a recessed area for covering, and preventing removal of, a screw which secures the back panel of the equipment when the control switch cover assembly is over the control switch with the said recessed area of said tension plate against the back panel covering such a screw.

10. The control switch cover assembly of claim 4, which further comprises the features described in claim 5; the tongue described in claim 6; the projection of claim 8; and the recessed area of said tension plate described in claim 9.

* * * * *